US007616181B2

(12) United States Patent
Kuo et al.

(10) Patent No.: US 7,616,181 B2
(45) Date of Patent: Nov. 10, 2009

(54) DISPLAY WITH SYSTEM-ON-PANEL DESIGN

(75) Inventors: Chun-Hung Kuo, Tainan (TW); Chee-Seng Tan, Hsinchu (TW); Wein-Town Sun, Taoyuan Hsien (TW)

(73) Assignee: AU Optronics Corp., Hsinchu (TW)

( * ) Notice: Subject to any disclaimer, the term of this patent is extended or adjusted under 35 U.S.C. 154(b) by 728 days.

(21) Appl. No.: 11/131,389

(22) Filed: May 18, 2005

(65) Prior Publication Data

US 2006/0055692 A1 Mar. 16, 2006

(30) Foreign Application Priority Data

Sep. 14, 2004 (TW) ..... 93127746 A

(51) Int. Cl.
*G09G 3/36* (2006.01)

(52) U.S. Cl. ..... 345/98; 345/99; 345/100; 345/204; 345/205

(58) Field of Classification Search ..... 345/98–100, 345/204, 205
See application file for complete search history.

(56) References Cited

U.S. PATENT DOCUMENTS 7,002,544 B2 * 2/2006 Sekido ..... 345/98

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A display adopting system-on-panel (SOP) design comprising a pixel array, a driving unit, a timing controller, and a first synchronization unit is provided. The pixel array is electrically connected with the driving unit. The timing controller generates a first set of timing signals to the driving unit. The first synchronization unit is set adjacent to an input of the driving unit for synchronizing the first set of timing signals.

9 Claims, 6 Drawing Sheets

DISPLAY WITH SYSTEM-ON-PANEL DESIGN

BACKGROUND OF THE INVENTION

1. Field of the Invention

This invention relates to a display adopting system-on-panel (SOP) design, and more particularly to a liquid crystal display (LCD) adopting SOP design capable of synchronizing control signals.

2. Description of Related Art

Liquid crystal displays (LCDs) with the advantages of slim size, low power consumption, and low radiation showing the potential to replace traditional cathode ray tube (CRT) displays are widely applied to electronic products such as desktop computer, personal digital assistant (PDA), notebook (NB), digital camera (DC), cell phone, etc. nowadays.

FIG. 1 is a block diagram showing a traditional active matrix LCD 1. The LCD 1 comprises a display panel 10 and a driving system 20. A pixel array 12 with a plurality of pixel capacitors 122 is formed on the display panel 10. Each of the pixel capacitors 122 is connected with a thin film transistor (TFT) 124. The TFT 124 is utilized as a switch to control the illumination of the pixel capacitor 122. The driving system 20 includes a control circuit 22, a source driver 24, and a scan driver 26. The source driver 24 is electrically connected to the source electrodes of the TFTs 124. The scan driver 26 is electrically connected to the gate electrodes of the TFTs 124. The control circuit 22 is utilized for translating the original displaying signals DS into display data D and control signals CS. The display data D and the control signals CS are applied to the source driver 24 and the scan driver 26 to generate source driving voltages Vs and gate driving voltages Vg. The source driving voltages Vs and the gate driving voltages Vg are then applied to the source electrodes and the gate electrodes of the TFTs 124 through the data lines 32 and the scan lines 34 respectively to form images on the display panel 10.

As shown, the TFTs 124 connected to the pixel capacitors 122 for switching the pixel capacitors 122 are arrayed on the display panel 10. In the past, restricted by the temperature limit of the glass substrate composing the display panel 10, only the amorphous thin film transistor (a-TFT) adopting an amorphous silicon layer specified with low temperature fabrication processes is able to be used to prevent the deformation of the display panel 10.

By contrast to the TFT 124 for switching the pixel capacitors 122, the transistor within the driving system 20 dealing with complicated display data needs a higher switching rate for a sufficiently high calculation speed, and the proper choice is polysilicon TFT. However, the polysilicon TFT cannot be fabricated on the glass substrate through the traditional semiconductor processes. The glass substrate cannot tolerate. Therefore, in a case shown in FIG. 2, the driving system 20 is fabricated on several silicon chips rather than on the display panel 10. The silicon chips are electrically connected to the pixel array 12 on the display panel 10 through some pipelines.

As the development of advance low temperature polysilicon (LTPS) process such as laser crystallization, the formation of polysilicon TFT on the glass-based display panel becomes possible. In the case shown in FIG. 3, by using the LTPS process, the source driver 24 and the scan driver 26 may be formed on the display panel 10 to simplify the fabrication process and reduce the weight of the LCD.

The case of FIG. 3 still has a silicon chip for allocating control circuit 22, and some assembling steps for electrically connecting the control circuit 22 to the driver 24, 26 on the display panel 10 through some pipelines are demanded. For further reducing the weight of the LCD, in the case shown in FIG. 4, the control circuit 22 is integrated on the display panel 10 to result a system-on-panel (SOP) display.

The signals applied to the source driver 24 and the scan driver 26 must have perfect synchronization to make sure the pixel array 12 displays images correctly. However, in the SOP display shown in FIG. 4, the control circuit 22 cannot lean to the source driver 24 and the scan driver 26 simultaneously due to the width limitation of the frame region in the display panel 10. Therefore, a large signal transmitting distance between the control circuit 22 and the drivers 24, 26 is unpreventable and may result a significant timing delay or signal mismatch to degrade the image quality.

Accordingly, how to make sure a good synchronization of all the signals applied to the drives is quite important for a correct and good image quality especially for a display adopting SOP design.

SUMMARY OF THE INVENTION

The present invention focuses on the problem of timing delay and signal mismatch as signals transmit from the control circuit to the drivers on a system-on-panel (SOP) display panel.

An SOP display panel provided in the present invention comprises a pixel array, a driving unit, a timing controller, and a first synchronization unit. The driving unit is electrically connected to the pixel array. The timing controller is configured to apply a first set of timing signals to the driving unit. The first synchronization unit is electrically connected to an input of the driving unit for synchronizing the first set of timing signals.

Reference will now be made in detail to the preferred embodiments of the present invention, examples of which are illustrated in the accompanying drawings. Wherever possible, the same reference numbers will be used throughout the drawings to refer to the same or like parts.

BRIEF DESCRIPTION OF THE DRAWINGS

The present invention will now be specified with reference to its preferred embodiment illustrated in the drawings, in which.

DETAIL DESCRIPTION OF THE PREFERRED EMBODIMENTS

Figure 5:
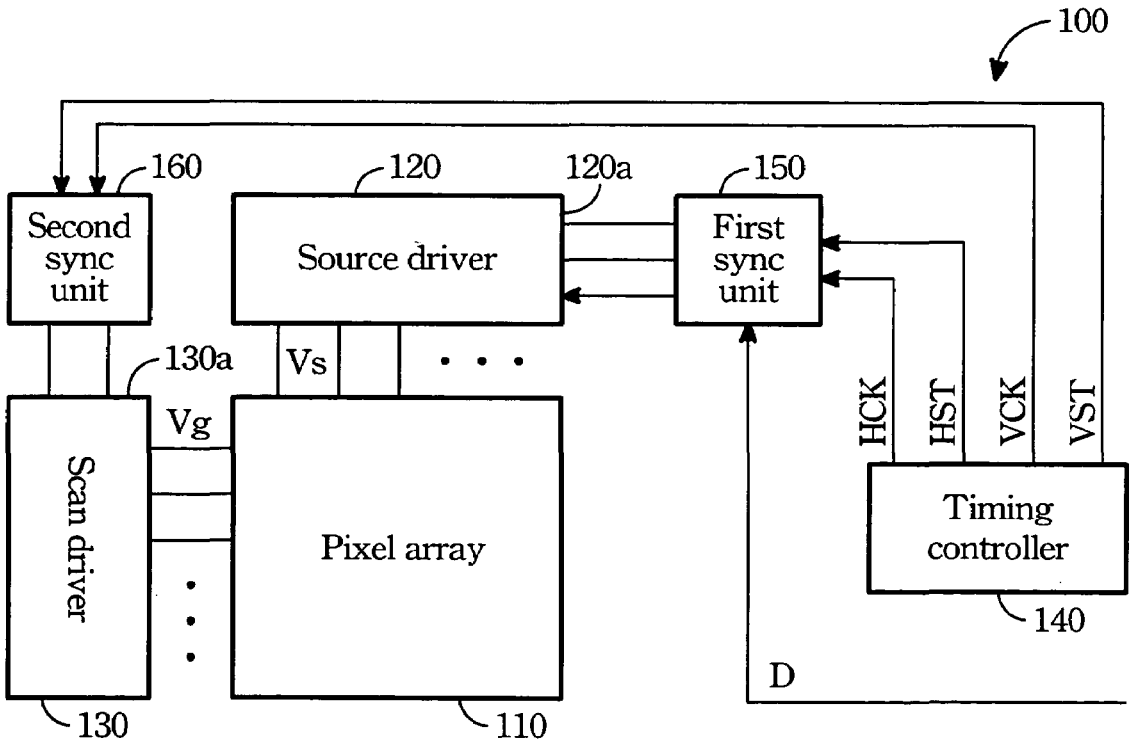
FIG. 5 shows a first embodiment of a system-on-panel (SOP) display according to the present invention.

FIG. 5 shows a first embodiment of a system-on-panel (SOP) display panel 100 in accordance with the present invention. This display panel 100 includes a pixel array 110, a source driver 120, a scan driver 130, a first synchronization unit 150, a second synchronization unit 160, and a timing controller 140 formed on a glass substrate (not shown in this figure). Each pixel capacitors within the pixel array 110 is electrically connected to a TFT (not shown). The TFT with a source electrode electrically connected to the source driver 120 and a gate electrode electrically connected to the scan driver 130 acts as a switch for controlling the operation of the pixel array 110.

The timing controller 140 is configured to generate a first set of timing signals, which includes a first clock signal HCK and a first starting signal HST, and a second set of timing signals, which includes a second clock signal VCK and a second starting signal VST. The first set of timing signals and the second set of timing signals are transmitted to the source driver 120 and the scan driver 130 respectively. In addition, a display data signal D having the content of images is applied to the source driver 120. The source driver 120 samples the display data signal D with the timing decided by the first clock signal HCK and the first starting signal HST to generate a source driving voltage Vs. The source driving voltage Vs is then applied to the pixel array 110 column by column. The scan driver 130 generates a gate driving voltage Vg with the timing decided by the second clock signal VCK and the second starting signal VST. The gate driving voltage Vg is then applied to the pixel array 110 row by row.

In addition to the first set of timing signals and the second set of timing signals, the timing controller 140 is capable of generating some additional timing signals and starting signals for the need of different source driver 120 designs.

In order to prevent the mismatch among the timing of the first clock signal HCK, the first starting signal HST, and the display data signal D to result a wrong source driving voltage Vs, the first synchronization unit 150 is set adjacent and electrically connected to an input 120*a* of the source driver 120 and is configured to synchronize the first clock signal HCK with the first starting signal HST before they entering the source driver 120. In order to prevent the mismatch between the second clock signal VCK and the second starting signal VST to result a wrong gate driving voltage Vg, the second synchronization unit 160 is set adjacent and electrically connected to an input 130*a* of the scan driver 130 and is configured to synchronize the second clock signal VCK with the second starting signal VST before they entering the scan driver 130.

It is noted that in this embodiment, two synchronization units 150 and 160 are used for synchronizing the signals HCK, HST, VCK, VST applied to the source driver 120 and the scan driver 130 respectively. However, as the source driver 120 is adjacent to the timing controller 140, the first clock signal HCK, the first starting signal HST, and the display data signal D may maintain a good synchronization due to a short signal transmitting distance. Thus, the first synchronization unit 150 may be removed. On the other hand, as the scan driver 130 is adjacent to the timing controller 140, the second clock signal VCK and the second starting signal HST may maintain a good synchronization due to a short signal transmitting distance. Thus, the second synchronization unit 160 may be removed.

Figure 6:
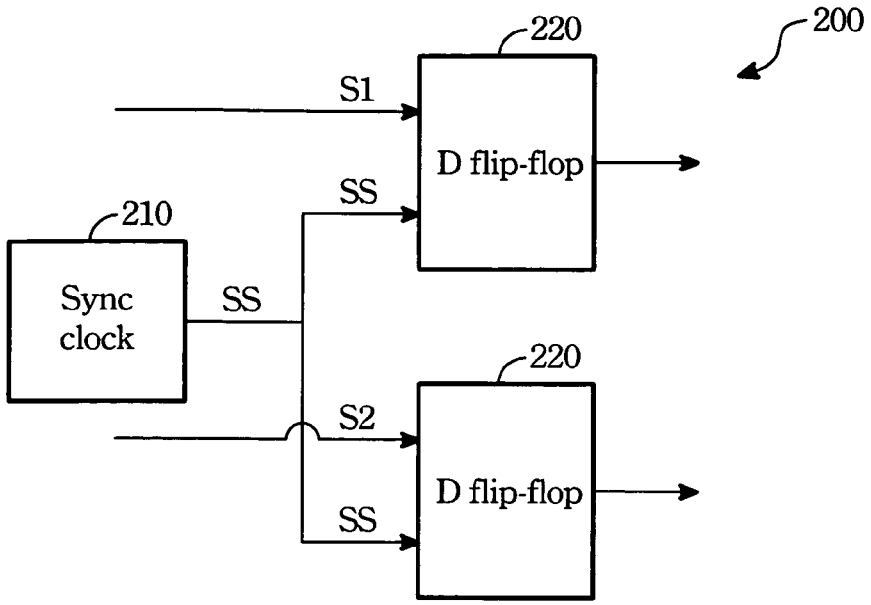
FIG. 6 shows a typical synchronization unit.

FIG. 6 shows a typical synchronization unit 200 adopted in the present invention. As shown, the synchronization unit 200 has a synchronization clock 210 and a plurality of D flip-flops 220. The synchronization clock 210 provides a standard timing signal SS to the D flip-flops 220. The D flip-flops 220 adjust the timing of the input signals S1 and S2 according to the standard timing signal SS. As the first synchronization unit 150 in the first embodiment is concerned, the input signals are the first clock signal HCK and the first starting signal HST. As the second synchronization unit 160 in the first embodiment is concerned, the input signals are the second clock signal VCK and the second starting signal VST.

Figure 7:
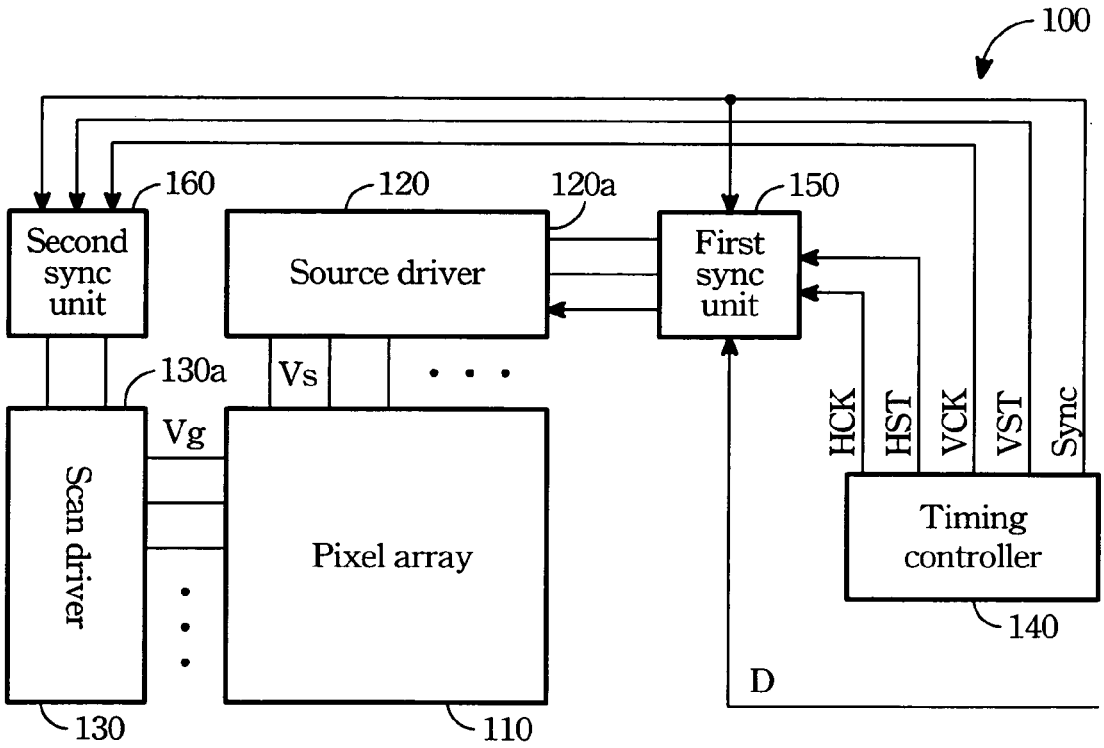
FIG. 7 shows a second embodiment of an SOP display according to the present invention.

FIG. 7 shows a second embodiment of the SOG display panel 100 in the present invention. The timing controller 140 in this embodiment is configured to generate a synchronizing signal Sync in addition to the first clock signal HCK, the first starting signal HST, the second clock signal VCK, and the second starting signal VST. A display data signal D is applied to the source driver 120 through the first synchronization unit 150. The synchronizing signal Sync is applied to the first synchronization unit 150 and the second synchronization unit 160 acting as a timing standard for adjusting the first clock signal HCK, the first starting signal HST, the display data signal D, the second clock signal VCK, and the second starting signal VST. That is, the synchronization clock 210 within the synchronization unit 200 may be functional replaced by the synchronizing signal Sync, so that the first synchronization unit 150 and the second synchronization unit 160 in this embodiment can be simplified but maintain a good synchronization output.

Figure 8:
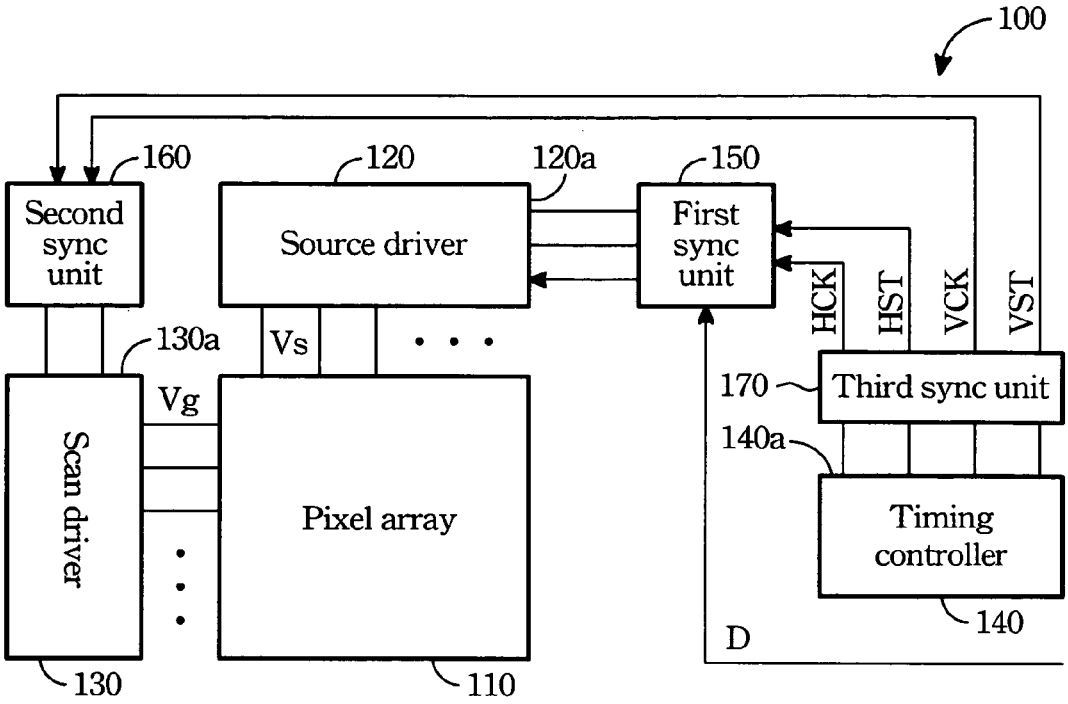
FIG. 8 shows a third embodiment of an SOP display according to the present invention.

FIG. 8 shows a third embodiment of the SOG display panel 100 in the present invention. By contrast to the first embodiment, an additional third synchronization unit 170 is integrated in this embodiment. The third synchronization unit 170 is located adjacent and electrically connected to an output of the timing controller 140 to make sure the first set of timing signals, including the first clock signal HCK and the first starting signal HST, and the second set of timing signals, including the second clock signal VCK and the second starting signal VST, performing a good synchronization when leaving the timing controller 140. The additional third synchronization unit 170 may reduce the mismatch among the timing of the first clock signal HCK, the first starting signal HST, the second clock signal VCK, and the second starting signal VST when reaching the first synchronization unit 150 and the second synchronization unit 160, so as to prevent the wrong operation of the first synchronization unit 150 and the second synchronization unit 160 as the timing mismatch is too large to be adjusted.

Figure 9:
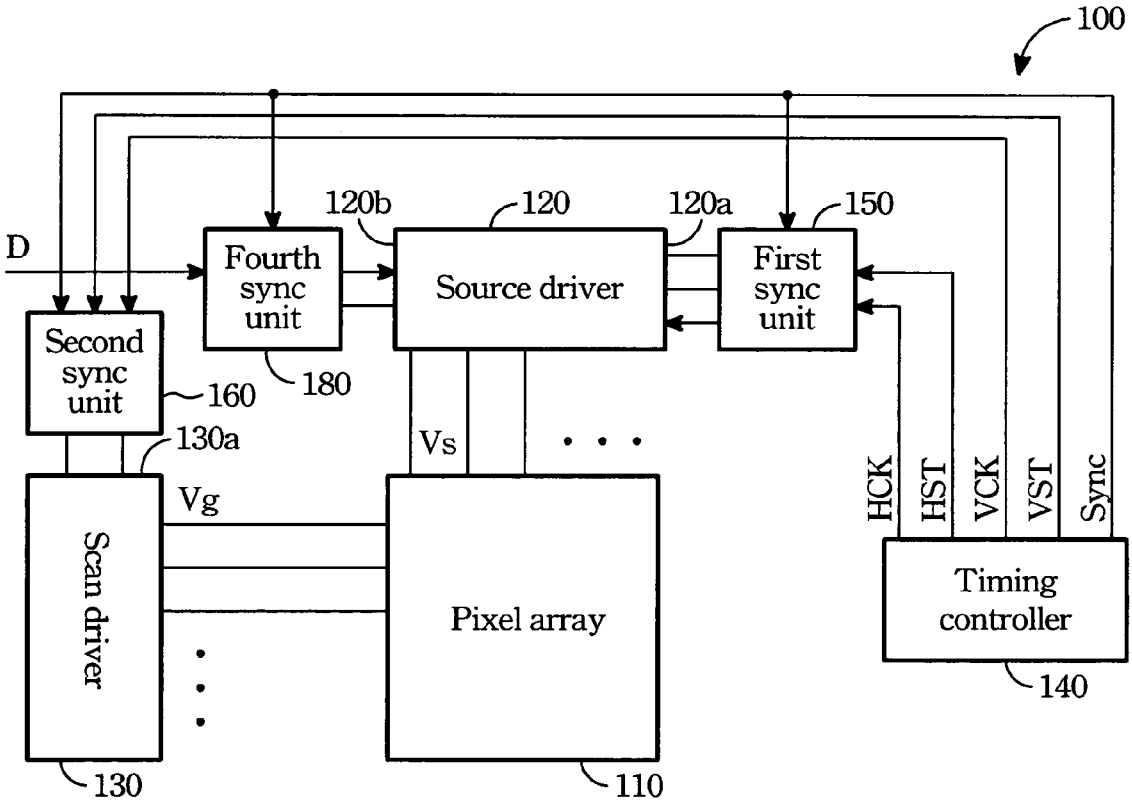
FIG. 9 shows a fourth embodiment of an SOP display according to the present invention.

FIG. 9 shows a fourth embodiment of the SOG display panel 100 in the present invention. By contrast to the first embodiment, an additional fourth synchronization unit 180 is integrated in this embodiment. The first synchronization unit 150 is adjacent and electrically connected to an input 120*a* of the source driver 120, and the fourth synchronization unit 180 is adjacent and electrically connected to another input 120*b* of the source driver 120. The first set of timing signals, including the first clock signal HCK and the first starting signal HST, and the display data signal D are synchronized by the first synchronization unit 150 and the fourth synchronization unit 180 respectively before applying to the source driver 120. The first synchronization unit 150 and the fourth synchronization unit 180 may have synchronization clocks with identical timing to synchronize the first set of timing signals with the display data signal D, or the timing controller 140 may generate a synchronizing signal to the first synchronization unit 150 and the fourth synchronization unit 180 as a synchronizing standard for matching the timing of the first set of timing signals and the display data signal D.

Figure 10:
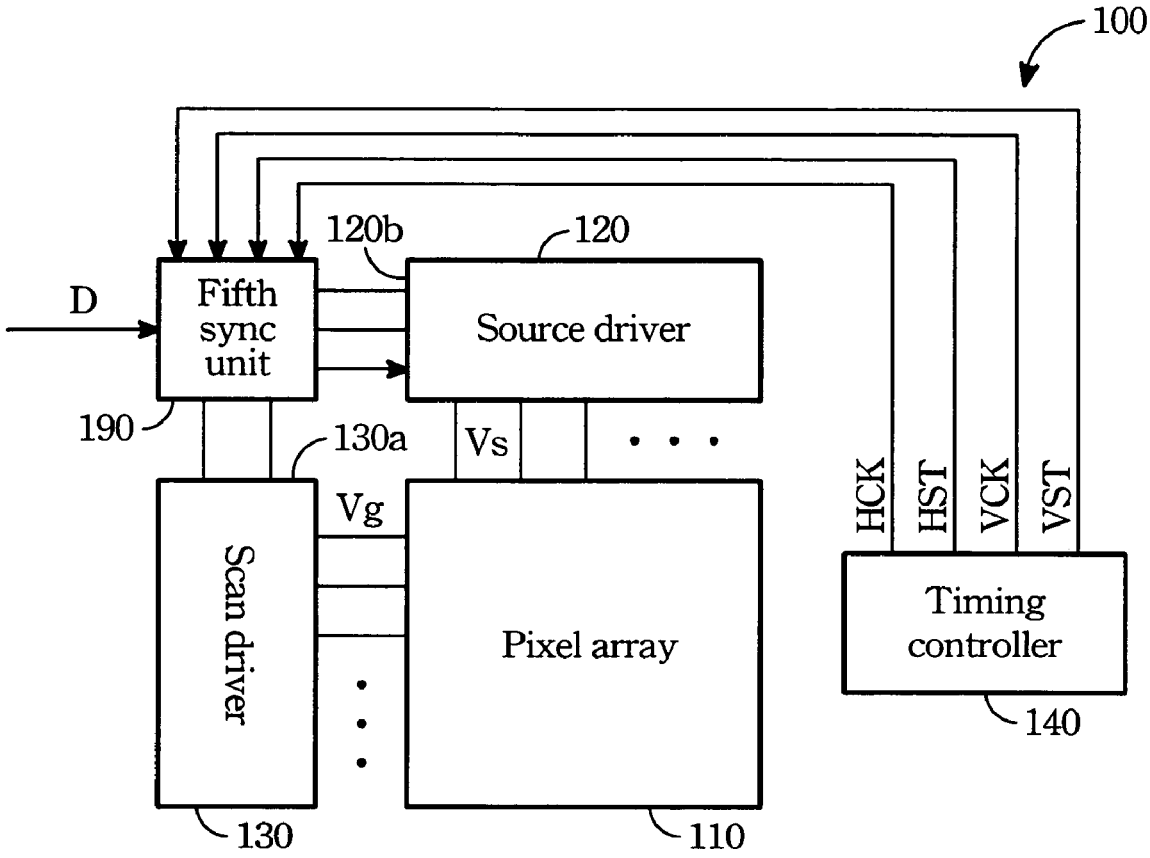
FIG. 10 shows a fifth embodiment of an SOP display according to the present invention.

FIG. 10 shows a fifth embodiment of the SOG display panel 100 in the present invention. By contrast to the first embodiment, this embodiment needs merely a fifth synchronization unit 190. The fifth synchronization unit 190 is located adjacent and electrically connected to the left side input 120*b* of the source driver 120 and the upper side input 130*a* of the scan driver 130. The first set of timing signals, including the first clock signal HCK and the first starting signal HST, the second set of timing signals, including the second clock signal VCK and the second starting signal VST, and the display data signal D are all synchronized by the fifth synchronization unit 190. Then, the display data signal D, the first clock signal HCK, and the first starting signal HST are applied to the source driver 120 through the left side input 120*b* of the source driver 120, and the second clock signal VCK and the second starting signal VST are applied to the scan driver 130 through the upper side input 130*a* of the scan driver.

Figure 1:
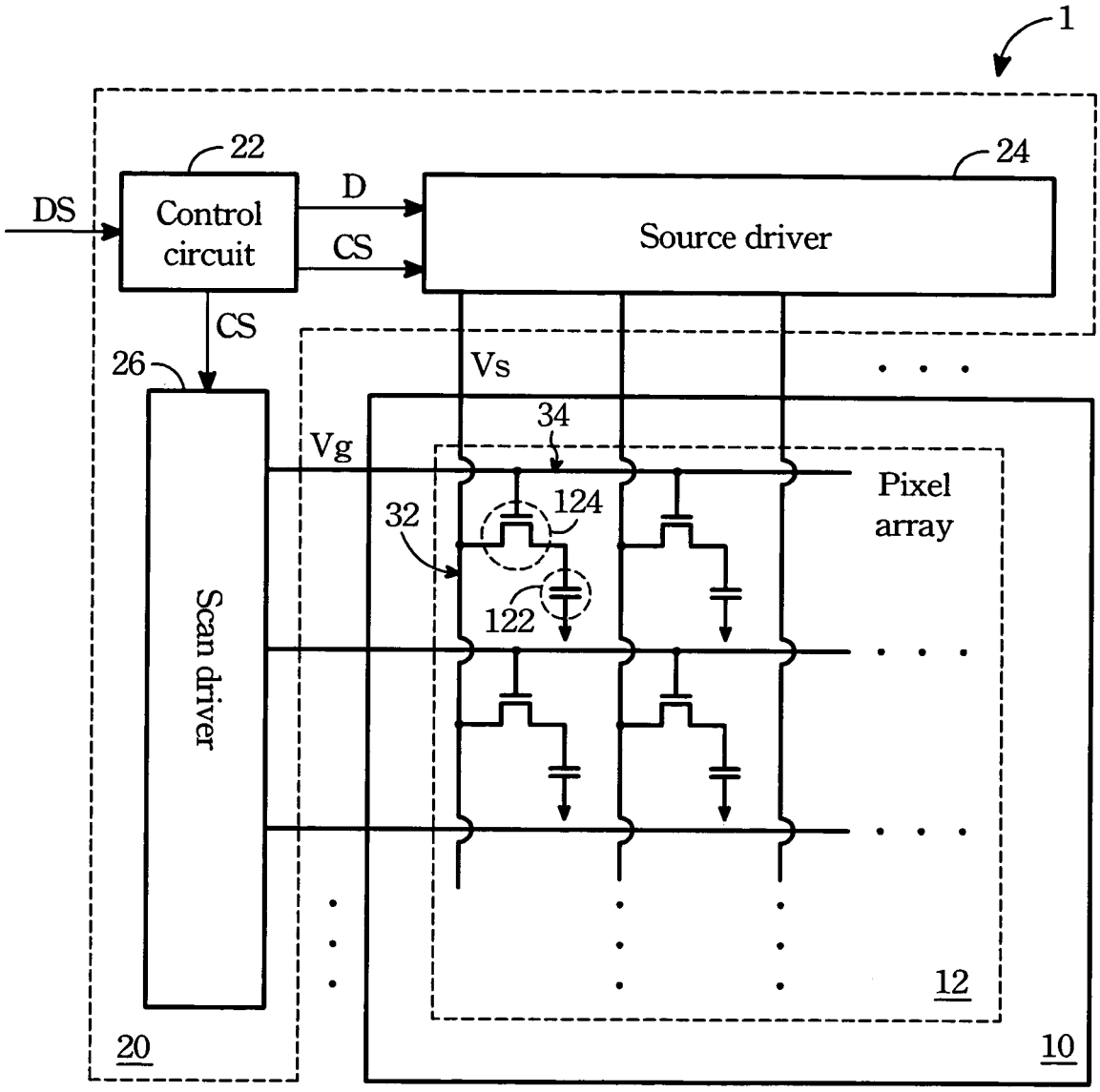
FIG. 1 (Related Art)
FIG. 1 shows a block diagram of a traditional active matrix LCD.
Figure 2:
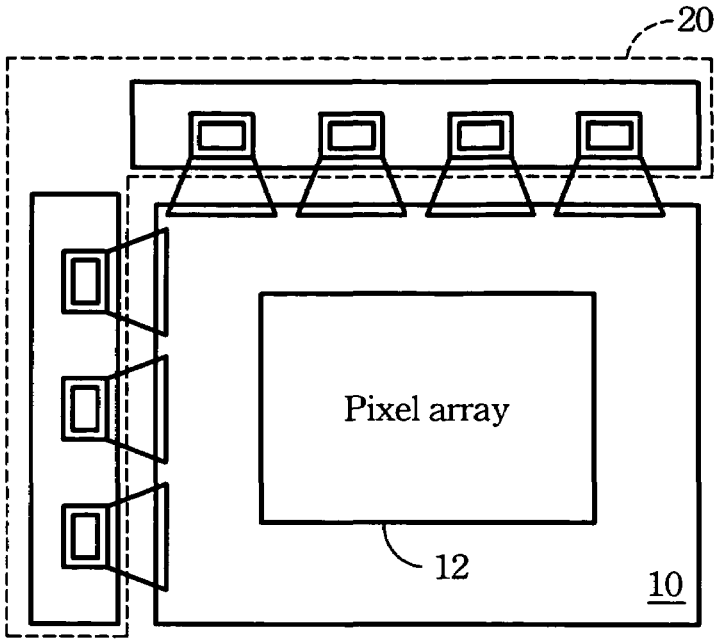
FIG. 2 (Related Art)
FIG. 2 shows a traditional LCD with the driving system formed on silicon chips.
Figure 3:
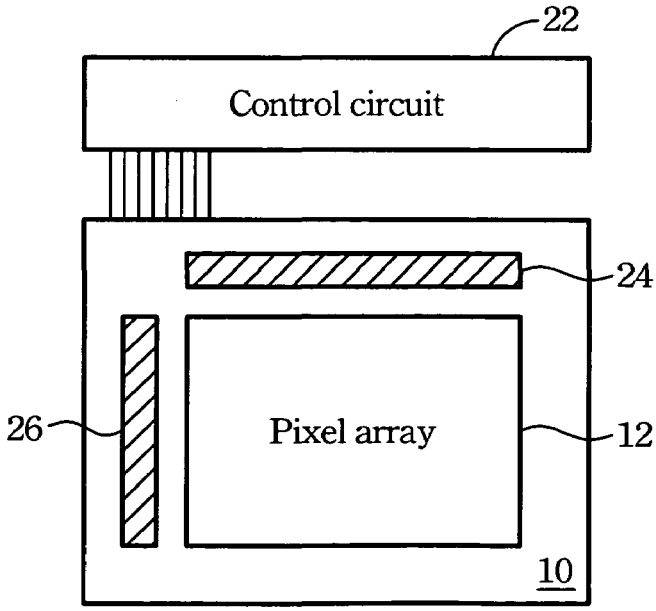
FIG. 3 (Related Art)
FIG. 3 shows another traditional LCD with the drivers formed on the display panel.
Figure 4:
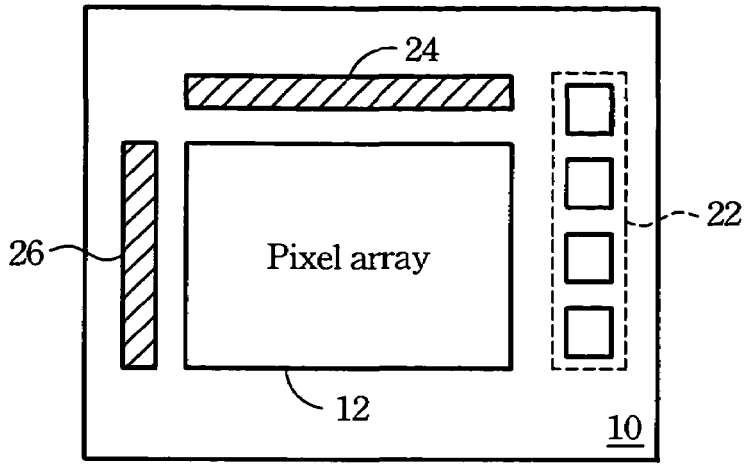
FIG. 4 (Related Art)
FIG. 4 shows another traditional LCD with the control circuit and the drivers formed on the display panel.

By contrast to the traditional SOG display panel shown in FIG. 4, which has a main problem of timing delay due to large signal transmitting distance to result signal mismatch, the SOG display panel 100 in the present invention shown in FIG. 5 synchronizes the signals HCK, HST, VCK, VST before they are applied to the source driver 120 and the scan driver 130. The synchronized signals HCK, HST, VCK, VST are thus translated to correct source driving voltages Vs and gate driving voltages Vg applying to the pixel array 110. In addition, the synchronized signals HCK, HST, VCK, VST also guarantee a perfect matching between the source driving voltage Vs and the gate driving voltage Vg to form correct and clear images.

With the example and explanations above, the features and spirits of the invention will be hopefully well described. Those skilled in the art will readily observe that numerous modifications and alterations of the device may be made when retaining the teaching of the invention. Accordingly, the appended claims are intended to cover all embodiments without departing from the spirit and scope of the present invention.

What is claimed is:

1. A display panel, comprising:

a pixel array;

a source driver electrically connected to the pixel array;

a scan driver electrically connected to the pixel array;

a timing controller configured to apply a first set of timing signals to the source driver and a second set of timing signals to the scan driver;

a first synchronization unit, electrically connected to an input of the source driver for synchronizing the first set of timing signals;

a second synchronization unit, electrically connected to an input of the scan driver for synchronizing the second set of timing signals; and a fourth synchronization unit, electrically connected to another input of the source driver, for synchronizing display data applied to the source driver through the fourth synchronization unit with the first set of timing signals.

2. The display panel according to claim 1, wherein the second set of timing signals includes a second clock signal and a second starting signal, and the second synchronization unit synchronizes the second clock signal with the second starting signal.

3. The display panel according to claim 1, wherein the second synchronization unit includes a second synchronization clock.

4. The display panel according to claim 1, wherein the timing controller further applies a synchronizing signal to the first synchronization unit and the second synchronization unit to synchronize the first set of timing signals with the second set of timing signals.

5. The display panel according to claim 1, wherein the timing controller further applies a synchronizing signal to the first synchronization unit and the fourth synchronization unit to synchronize the first set of timing signals with the display data.

6. The display panel according to claim 1, wherein the fourth synchronization unit includes a fourth synchronization clock for synchronizing the first set of timing signals with the display data.

7. The display panel according to claim 1, wherein the first synchronization unit is configured to synchronize the first set of timing signals with display data applied to the source driver through the first synchronization unit.

8. The display panel according to claim 1, wherein the first set of timing signals includes a first clock signal and a first starting signal, and the first synchronization unit synchronizes the first clock signal with the first starting signal.

9. The display panel according to claim 1, wherein the first synchronization unit includes a first synchronization clock.

* * * * *